United States Patent [19]

Turro

[11] Patent Number: 4,709,706

[45] Date of Patent: Dec. 1, 1987

[54] CIGARETTE HOLDER

[76] Inventor: Juan G. Turro, 1558 Sevilla Ave., Coral Gables, Fla. 33134

[21] Appl. No.: 777,082

[22] Filed: Sep. 17, 1985

[51] Int. Cl.[4] ..... A24F 13/08

[52] U.S. Cl. ..... 131/240.1; 131/241; 131/257; 131/260

[58] Field of Search ..... 131/231, 241, 257, 240.1, 131/260

[56] References Cited

U.S. PATENT DOCUMENTS 1,628,937 5/1927 Walberg ..... 131/240.1

2,182,916 12/1939 Orsinee ..... 131/240.1

*Primary Examiner*—V. Millin

[57] ABSTRACT

A cigarette holder having two S-shaped flat arms fitted together by grooves or notches placed midway along the arms. The holder is held together at their lower parts by magnetic attraction but are readily separable at their upper parts when a cigarette is placed between them.

1 Claim, 4 Drawing Figures

CIGARETTE HOLDER

BACKGROUND

A cigarette holder is provided to insure that a resting cigarette is maintained in a secure fashion until a smoker removes it.

SUMMARY OF THE INVENTION

A holder is constructed from two S-shaped arms that are attached to each other by grooves or notches placed midway between each arm forming an X. Each arm has a magnet attached to one end when the holder is assembled the arms with attached magnets are adjacent to each other so that each arm has a tendency to approach each other. The tension applied magnetically is mild enough to allow a resting cigarette to be inserted between them with a medium force strong enough to retain the cigarette in any position desired.

DETAILED DESCRIPTION OF THE INVENTION

Figure 1:
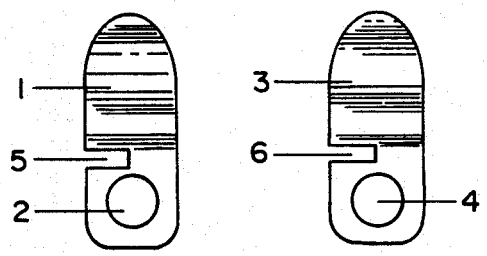
FIG. 1 illustrates two S-shaped arms in the unassembled position.
Figure 2:
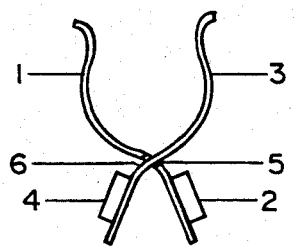
FIG. 2 illustrates the two S-shaped arms in the assembled position.
Figure 3:
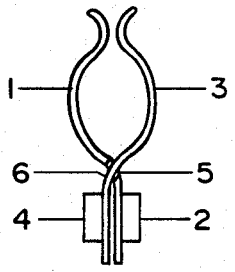
FIG. 3 illustrates the assembly of FIG. 4 with the bottom portion of the arm attracted to each other.
Figure 4:
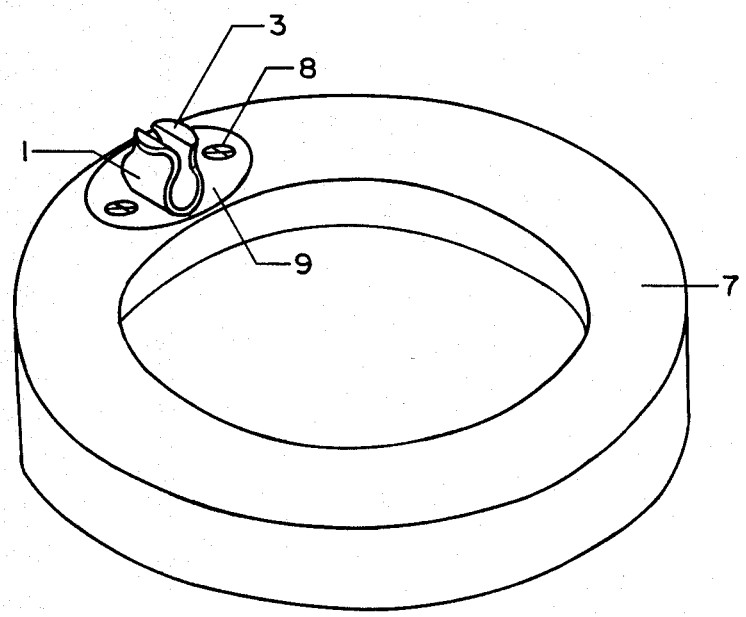
FIG. 4 illustrates the assembly of FIG. 2. incorporated into an ashtray.

FIG. 1 illustrates the unassembled holder's flat S-shaped arms 1 and 3 having a top and base portion with magnets 2 and 4 secured to the base of each arm. Each arm is provided with grooves or notches 5 and 6. FIG. 2 illustrates the assembled holder. FIG. 3 illustrates a side view of the holder with magnets 2 and 4 attracted to each other. FIG. 4 illustrates the holder incorporated into an ashtray 7.

What is claimed is:

1. A cigarette holder comprising two substantially shaped flat arms having formed midway in each arm a groove in the side of each arm wherein said flat arms are fitted together to form an X having a top and a base portion; a magnet included in each portion of said arms at said base wherein the arms at the base have a tendency to be drawn to each other and the arms at the top portion have a tendency to be drawn to each other and being so positioned so as to permit positioning of cigarette between the arms at the top portion.

* * * * *